US005371916A

United States Patent [19]

Vosbikian

[11] Patent Number: 5,371,916

[45] Date of Patent: Dec. 13, 1994

[54] T-SHAPED BROOM HEAD

[75] Inventor: Peter S. Vosbikian, Morrestown, N.J.

[73] Assignee: Quickie Manufacturing Corporation, Cinnaminson, N.J.

[21] Appl. No.: 12,501

[22] Filed: Feb. 2, 1993

[51] Int. Cl.[5] ..... A46B 15/00

[52] U.S. Cl. ..... 15/176.2; 15/146; 15/159.1; 15/145

[58] Field of Search ..... 15/146, 176.2, DIG. 6, 15/159.1, 145, 176.1, 176.3, 176.4, 176.5, 176.6; 403/299

[56] References Cited

U.S. PATENT DOCUMENTS

| | | | |
|---|---|---|---|
| 430,077 | 6/1890 | Jenness | 15/DIG. 6 |
| 1,253,904 | 1/1918 | Stokes | 15/145 |
| 2,860,361 | 11/1958 | Moody | 15/176.2 |
| 2,915,768 | 12/1959 | Hall | 15/145 |
| 3,218,661 | 11/1965 | Fielder, Jr. | 15/145 |
| 3,218,662 | 11/1965 | Fielder, Jr. | 15/145 |
| 3,629,894 | 12/1971 | Stefany | 15/146 |
| 3,894,807 | 7/1975 | Betz, III | 15/176.2 |
| 4,433,931 | 2/1984 | Malish et al. | 15/145 |
| 4,486,913 | 12/1984 | Kubick | 15/146 |
| 4,541,139 | 9/1985 | Jones et al. | 15/176.2 |
| 4,642,837 | 2/1987 | Nichols et al. | 15/146 |
| 4,756,039 | 7/1988 | Pardo | 15/DIG. 6 |
| 5,010,616 | 4/1991 | Berti | 15/159.1 |
| 5,274,872 | 1/1994 | Rich | 15/145 |

*Primary Examiner*—David A. Scherbel
*Assistant Examiner*—Patrick F. Brinson
*Attorney, Agent, or Firm*—Eckert Seamans Cherin & Mellott

[57] ABSTRACT

A broom head has a force-distributing handle socket. The broom head generally defines a plane and is structured for connection to a broom handle. The broom head includes a force distributing socket for a handle, the force distributing handle socket including a receptacle defining an axis for a handle formed on or within a surface of the broom head and a support member surrounding and axially extending a distance above the receptacle. The support member has at least two sidewalls defining an axial interior cavity and a terminal planar top having an axial cavity along the length to provide an interference fit along the length of the support member between an operatively connected handle and the support member. The support member preferably has a concave shape on the interior surfaces of the at least two sidewalls and an annular planar top sized to engage a conventional cylindrically-shaped broom handle inserted therein, with an interference fit along the entire length of the support member.

16 Claims, 3 Drawing Sheets

T-SHAPED BROOM HEAD

BACKGROUND OF THE INVENTION

1. Field of the Invention

The invention relates the attachment of the operative head of an apparatus to a handle for manipulating the head, in particular the head of a cleaning apparatus such as a broom, that has an operative surface contact portion extending laterally of the longitudinal axis of the handle. More specifically, a broom head is made in a T-shape, with an elongated interference fit defined between the handle and the head for a distance adjacent an end of a handle received in a socket, thus distributing along this distance the forces generated during operation of the broom, and withstanding downward force against the broom head without damage or disconnection of the joint between the handle and the broom head.

2. Prior Art

Brooms are well known in the cleaning industry for cleaning in and about the home and commercial and industrial buildings. Brooms characteristically employ a plurality of individual debris-gathering fibers or bristles, connected to a broom head. The bristles are arranged on the head in a band extending laterally from the longitudinal axis of the handle to which the broom head is attached, typically on both sides. Using the handle, a user brushes the bristles over smooth or rough surfaces to gather debris using the fibers, generally working the broom head in a direction perpendicular to its extension lateral of the handle axis.

The handle is elongated, e.g., being about five feet (1.5 m) in length, and is grasped by the user at spaced points along a length above the head. The handle is conventionally attached to the broom head at a perpendicular or angular connection such as a coarsely threaded socket having threads along a short length, normally about one inch (2.5 cm). Alternatively, the handle may be received in a cylindrical bore and held by friction or by a pin passing transversely through the handle and the socket.

Brooms have of course been known for many centuries, the earliest being a bound cylinder of thin twigs that were tied in a bundle to a handle, diverging to define an operative surface at the free ends of the twigs. More sophisticated techniques for connecting a fibers to a handle have come into existence, but it is an aspect of brooms that the surface at which the bristles bear against the cleaning surface extend laterally of the longitudinal axis of the handle. Therefore, a downward pressure on the broom head from the handle, which pressure is greater on one lateral side of the axis than the other, places a stress on the connection of the broom head to the handle.

In operating a broom, downward pressure is frequently exerted unevenly, bearing more strongly on the bristles on one side of the broom than the other. This is particularly true because users do not hold the broom perpendicular to the cleaning surface, instead inclining the handle away from the user's body and thereby inherently placing more pressure on one side than the other. Brooms are often made with uneven bristle lengths to allow the bristles to rest evenly on the cleaning surface when the handle is inclined, and if not the bristles frequently wear unevenly.

The conventional broom head is generally planar, having a wider dimension and a narrower dimension, the narrower dimension being the width of the band of bristles and the wider dimension being the sweeping swath as the broom is typically used. The moment arm acting on the Junction of the handle and the broom head due to uneven pressure on the broom head is greater when the pressure is uneven along the wider dimension, but in normal brushing action, force is exerted to move the broom perpendicular to the wider dimension. Thus, impacts of the broom against obstructions in the sweeping direction also place stress on the handle-broom head joint.

For attaching the bristles in the required pattern, a generally planar broom head has means for attaching the bristles on one side and means for attaching the handle on the other side. The bristles or fibers can be jammed into spaced bores in the broom head, molded into the material of the broom head, attached adhesively, etc. The broom head couples to the handle the forces applied to the bristles when brooming, using a thread, fitting and/or lateral pin as described above.

Brooms having bristles arranged parallel to the longitudinal axis of the handle are one general type, another type being characterized by a push broom. In a push broom, the handle attaches to the broom head at an angle between the handle axis and a line parallel to the bristles. In other respects, similar problems are encountered. A force exerted on the broom head in a manner that is not symmetrical to the axis of the handle, places a stress on the junction between the broom head and the handle. The stress can be substantial in certain situations, such as an impact at a lateral end of the broom head, or even the action of a user placing weight downwardly on the broom head, tending to force the broom head to one side or the other relative to the elongation of the broom head.

The stress on the conventional attachment of a broom handle and broom head i s a substantial shortcoming, and can easily result in the handle being prematurely disengaged from the broom head when a downward, particularly uneven force is applied during brooming operations. Disconnection occurs because the Joint defines a fulcrum at the point of connection between the broom head and broom handle. All the forces applied to the assembled broom by the user are communicated directly to this fulcrum point. Once the forces applied to the connection are greater than the joint can support, the broom head either pulls free or breaks off the end of the broom handle arranged in the joint. At worst, breakage renders the connecting means inoperable for reassembly and use. At best, the joint structures become badly worn and the connection is loosened to the point that subsequent detachment of the broom head is all the more likely to occur.

To better withstand the forces developed between the broom head and the handle without unduly stressing the joint, it is known to add a buttressing cap structure having members extending from the broom head, at points spaced from the handle axis, to a point on the handle that is axially spaced from the joint between the broom head and the end of the handle. The buttressing cap can be placed on top of the broom head. Typically made of a rigid polymer, the cap has sidewalls extending from the broom head to a collar receiving the handle above the basic handle-head joint. The sidewalls and cap define a hollow interior and terminate at an annular top opening (or collar) that is axially spaced a from the open socket on the broom head. The collar and the socket both receive the elongated handle. The collar receives the elongated handle via an interference fit. The socket receives the end of the handle in known manner. The cap has a large bottom opening shaped and configured to fit over the broom head.

The buttressing cap fitted over the broom head provides extra support for the broom construction because forces on the broom head are coupled more along the longitudinal axis of the handle. However, in large part the effect is to define a new and secondary fulcrum at the point of the collar on the handle. Downward brooming forces are distributed at the annular collar or top opening of the cap, relieving some of the force applied force on the direct connection of the handle and broom head at the open socket. However, the cap adds to the complexity and expense of manufacture and assembly because of the additional step of providing another member interposed between the broom head and broom handle. Furthermore, the cap substantially couples lateral force only to the annular top opening of the collar, the interior and bottom opening being hollow and thereby not engaging the handle. As a result, there is a tendency of the handle to bend between the collar and the socket.

It would be desirable to provide a force distributing handle support member to a broom head construction that distributes an applied downward brooming force over the entire length of the support member between an upper buttressing collar and the socket at the broom head and handle basic joint. Further, it would be desirable to integrally form the force distributing handle support member on the broom head. It also would be desirable to have a sufficiently durable support member to maintain the structural integrity and advantageous aspects of a supported broom construction despite continuous downward forces and laterally asymmetrical force applied during regular use. In addition, it would be desirable to optimize the manufacture of supported broom constructions.

SUMMARY OF THE INVENTION

It is an object of the invention to provide a broom head construction having an elongated handle support member arranged to distribute an applied downward force during brooming operations over the entire length of the handle receptacle on a broom head.

It is another object of the invention to provide a broom head construction that is secure along the handle axis against inadvertent disconnection at the socket connection, and secure against breakage due to applied downward forces to a handle during brooming operations, either at the end or socket connection with the handle and at an upper point of entry into the handle engaging structures.

It is another object to provide a sufficiently durable handle support socket on a broom head which maintains its structural integrity and advantageous aspects of a supported broom construction despite continuous, potentially asymmetrical downward forces during continuous use.

It is another object of the invention to provide an integrally formed handle support member on a surface of a broom head that is efficient and economical, having an integrally formed handle support member that closely engages the handle over a length adjacent the broom head.

These and other objects of the invention are met by a broom head construction according to the invention with a broom head with a force distributing handle support receptacle. The broom head generally defines a plane and is structured for connection to a broom handle. The broom head includes a force distributing socket for a handle, the force distributing handle socket comprising a receptacle defining an axis for a handle formed on or within a surface of the broom head and a support member surrounding and axially extending a distance above the receptacle. The support member has at least two opposite sidewalls defining an axial interior cavity and a top having an axial cavity along the length. The support member, and in particular substantially the full length of the axial cavity, provide an interference fit along the length of the support member between an operatively connected handle and the support member. The support member preferably has a partly cylindrical concave shape on the interior surfaces of the at least two sidewalls and an annular, e.g., planar top, sized to engage a conventional cylindrically-shaped broom handle with an interference fit along the entire length of the support member.

The force distributing handle socket may be positioned either perpendicular to the plane of the broom head, i.e., in a T-shaped configuration, or with members extending at an angle to the plane of the broom head, thereby attaching to the broom head at a space from the handle. In any event, the handle engaging structure as a whole bears against the handle along the length of the handle between the socket at the broom head and the top of the annular buttress fitting. The force distributing handle socket may be integrally molded or similarly formed with the broom head.

The objects are further met by an operative broom construction according to the invention with a broom head operatively attached to a broom handle and broom material. The broom construction includes a plurality of debris gathering bristles mounted on a bottom surface of a generally planar broom head. The broom head has receptacles on the bottom surface for attachment of individual debris gathering material directly therein, such as bristles, fibers or the like. The bristles may be arranged such that stiffer fibers are in the middle and softer fibers are on the edges.

The force distributing handle receiving structure of the broom head has a receptacle defining an axis for the handle, formed on or within a surface of the broom head, and a support member surrounding and axially extending a distance above the receptacle. The support member has at least two sidewalls defining an axial interior cavity and a top having an axial cavity along the length to provide an interference fit along the length of the support member between an operatively connected handle and the support member. The support member preferably has a concave shape on the interior surfaces of the at least two sidewalls and an annular planar top sized to engage a conventional cylindrically-shaped broom handle inserted therein with an interference fit along the entire length of the support member.

The broom handle is an elongated member having a length and shape configured to mount within the force distributing handle socket for coupling forces to the handle over the entire length between the socket and the annular top.

These and other advantages of the invention will become more apparent in connection with the following description of certain embodiments of the invention disclosed as non-limiting examples.

BRIEF DESCRIPTION OF THE DRAWINGS

There are shown in the drawings the embodiments of the invention as presently preferred. It should be understood that the invention is comparable of embodiment in a number of specific arrangements in accordance with the disclosure herein, and reference should be made to the appended claims rather than the discussion of exemplary embodiments to assess the scope of the invention in which exclusive rights are claimed. In the drawings.

DETAILED DESCRIPTION OF THE PREFERRED EMBODIMENTS

Although specific terms respecting shapes, directions and the like are used in the following description for the sake of clarity, these terms are intended to assist in the description of the particular structure of the invention selected for exemplary illustration, and are not intended to define or limit the scope of the invention.

Figure 1:
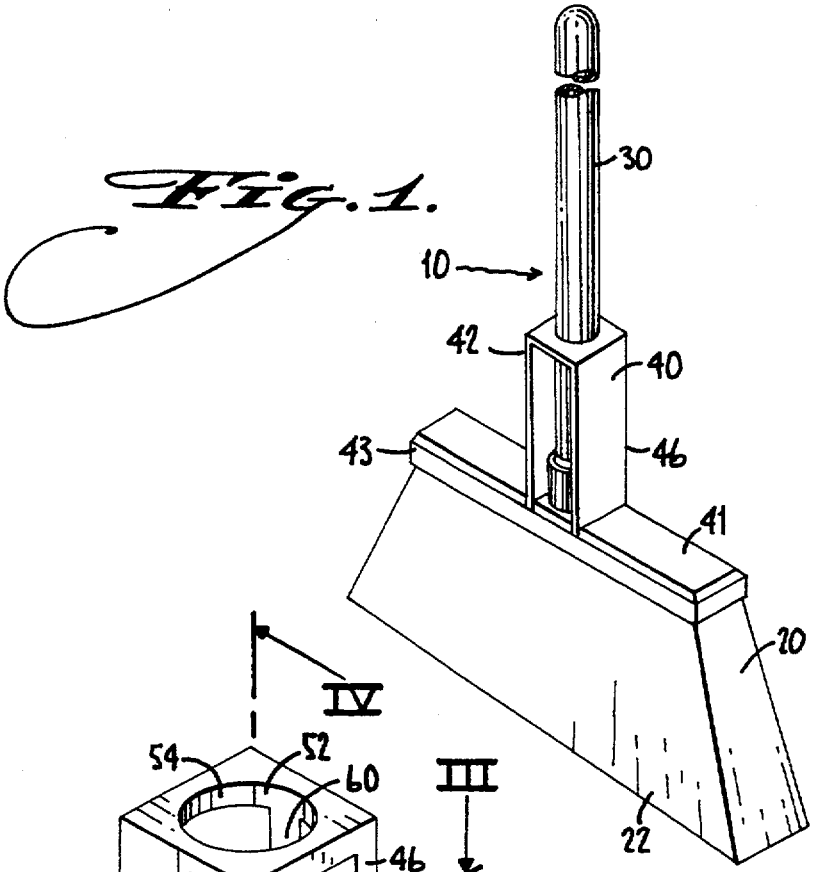
FIG. 1 is a perspective view of a broom arrangement according to the invention, with the handle attached to the broom head.

A broom head construction 10 according to the invention is shown generally in FIG. 1. The broom comprises bristles or similar broom material 20, a broom handle 30 and a broom head 40 whereby the broom material and handle are operatively connected.

The broom material 20 preferably comprises a plurality of individual debris gathering fibers or bristles 22 which are secured in known manner on an operative face of the broom head 40, i.e., the underside as shown in FIG. 1. For example, the bristles 22 can be molded into the material of the broom head, forced into bores in the broom head for frictional engagement, and/or attached by adhesive, etc. The bristles may be arranged such that stiffer fibers are in the middle and softer fibers are on the peripheral edges.

The broom head shown in the drawings is arranged such that the handle couples perpendicularly to the head. A push broom arrangement is also possible according to the invention, but is not shown. In a push broom arrangement the handle is joined to the head at an angle relative to the extension of the bristles rather than generally parallel to the extension of the bristles as shown in FIG. 1.

The broom head 40 has a generally planar body 41 that extends laterally from the longitudinal axis of the handle to ends 43. As a result of the extension of body 41, downward forces on the handle that are applied asymmetrically produce a moment arm on the joint between the handle and the broom head 40. According to the invention an elongated force distributing handle support socket 42 is arranged to receive a length of the broom handle at the end, and extending for a distance from the end, coupling the handle to the broom head while distributing the forces thereby developed between the handle and the broom head over the axial length of the socket 42 adjacent the broom head. The force distributing handle support socket 42 is positioned on a face of the broom head either perpendicular thereto, i.e., on the topside of the broom head as shown in FIG. 1, or on an edge of the broom head angular thereto as in a push broom (not shown).

Figure 2:
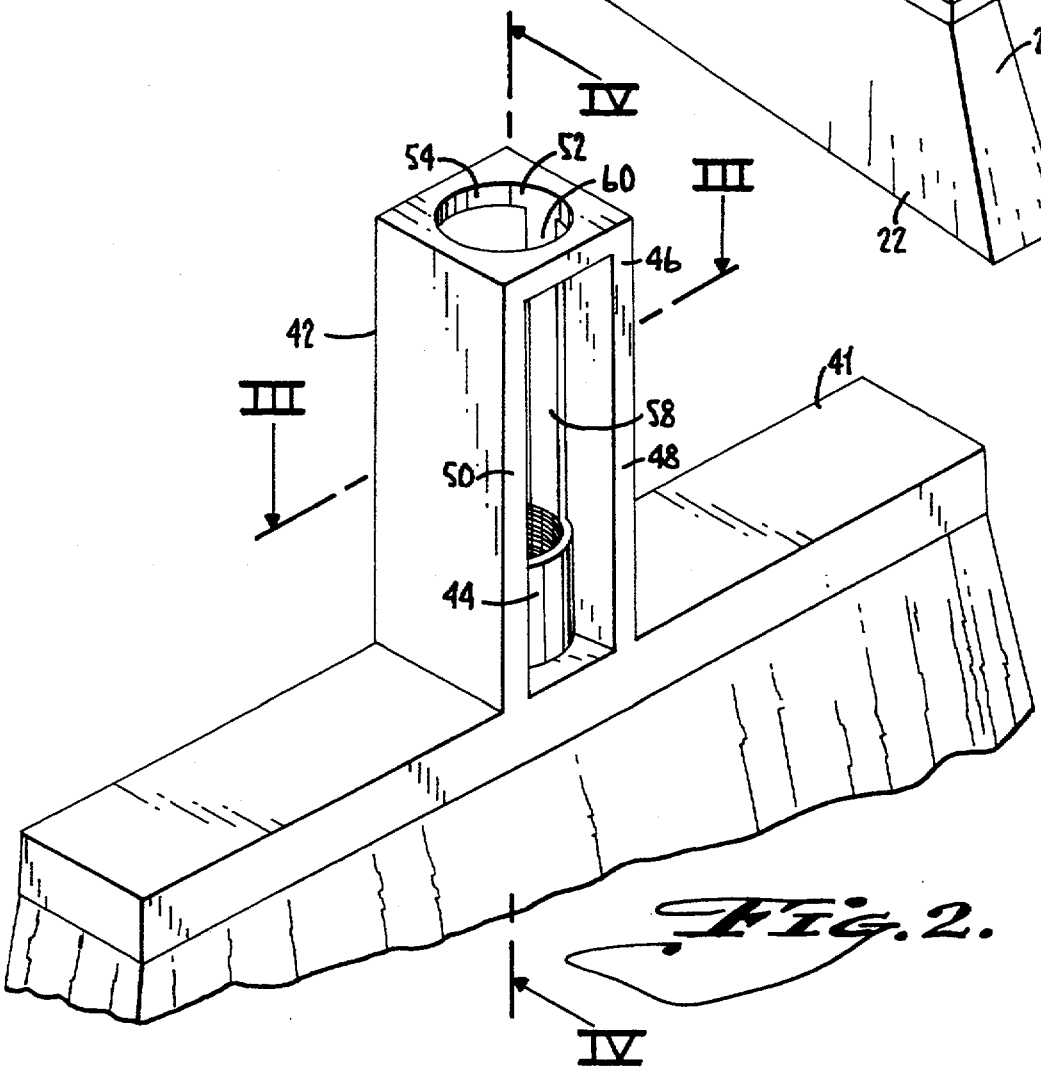
FIG. 2 is a partial perspective view of the broom head with the handle removed.
Figure 3:
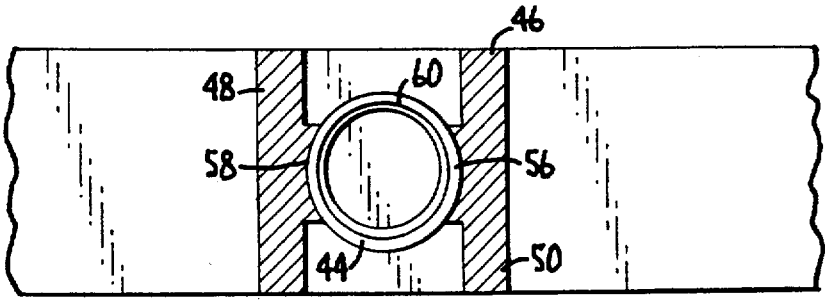
FIG. 3 is a partial section view taken along line 3—3 in FIG. 2, the handle not being shown.
Figure 4:
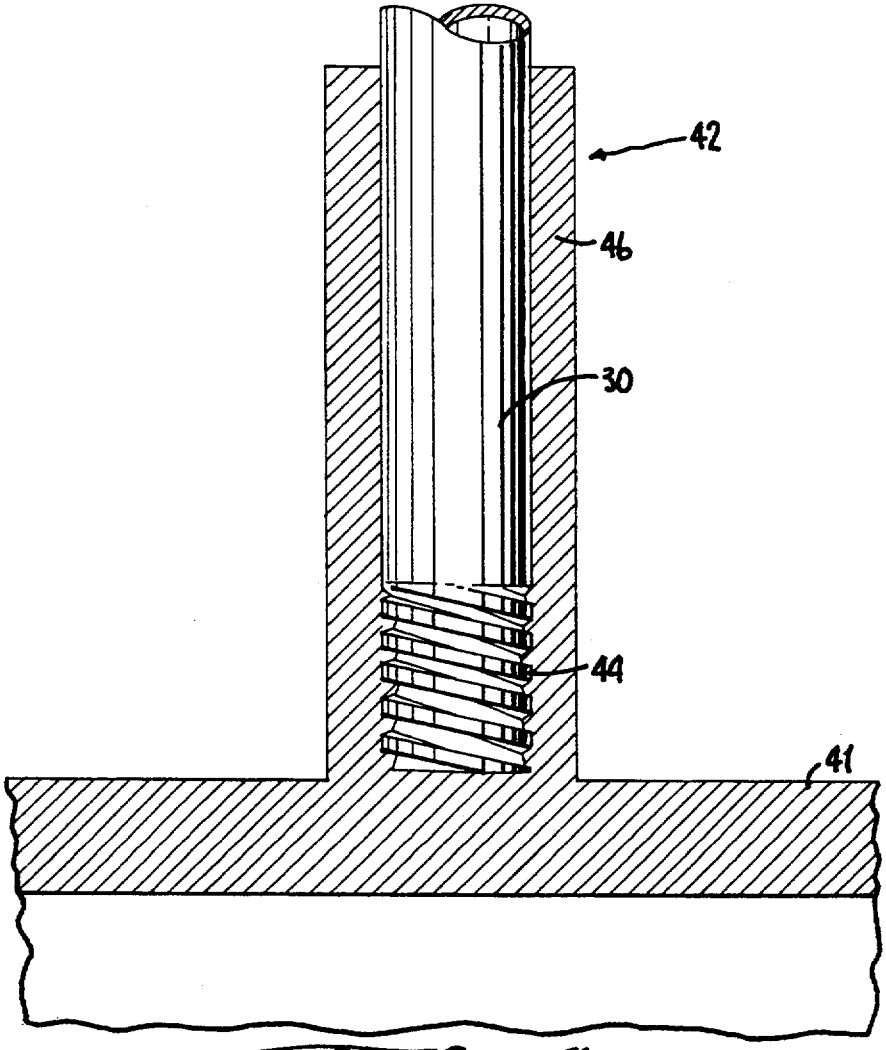
FIG. 4 is a partial section view taken along line 4—4 in FIG. 2, with the handle shown.

FIG. 2 shows the broom head of the invention in perspective with the handle removed. FIG. 2, and FIGS. 3 and 4, which are sectional views through the broom head at the handle support socket 42, show the structures whereby an interference fit is obtained between the socket 42 and the handle, all along the length of socket 42.

Figure 5:
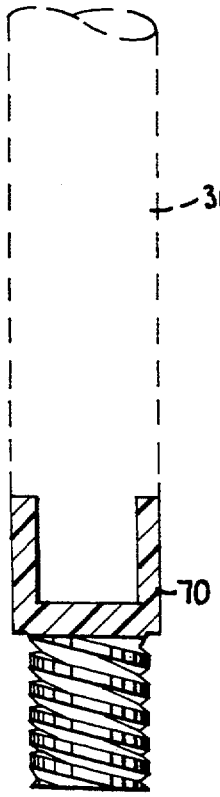
FIG. 5 is a partial perspective view of an alternative embodiment of the broom handle.

The force distributing support socket 42 comprises a receptacle 44 for engaging and securing the end of the broom handle. The receptacle 44 can be a threaded tube integral with the broom head as shown in FIG. 4, for receiving a standard threaded broomstick type handle. Preferably, the broom handle is comprised of cylindrical steel tubing having a hollow inner diameter and including a plastic insert 70 plugged into the lower end of the broom handle. The plastic insert is threaded at the lower end which extends from the plugged lower end of the broom handle to be received by the threaded receptacle 44 as shown in FIG. 5.

Figure 6:
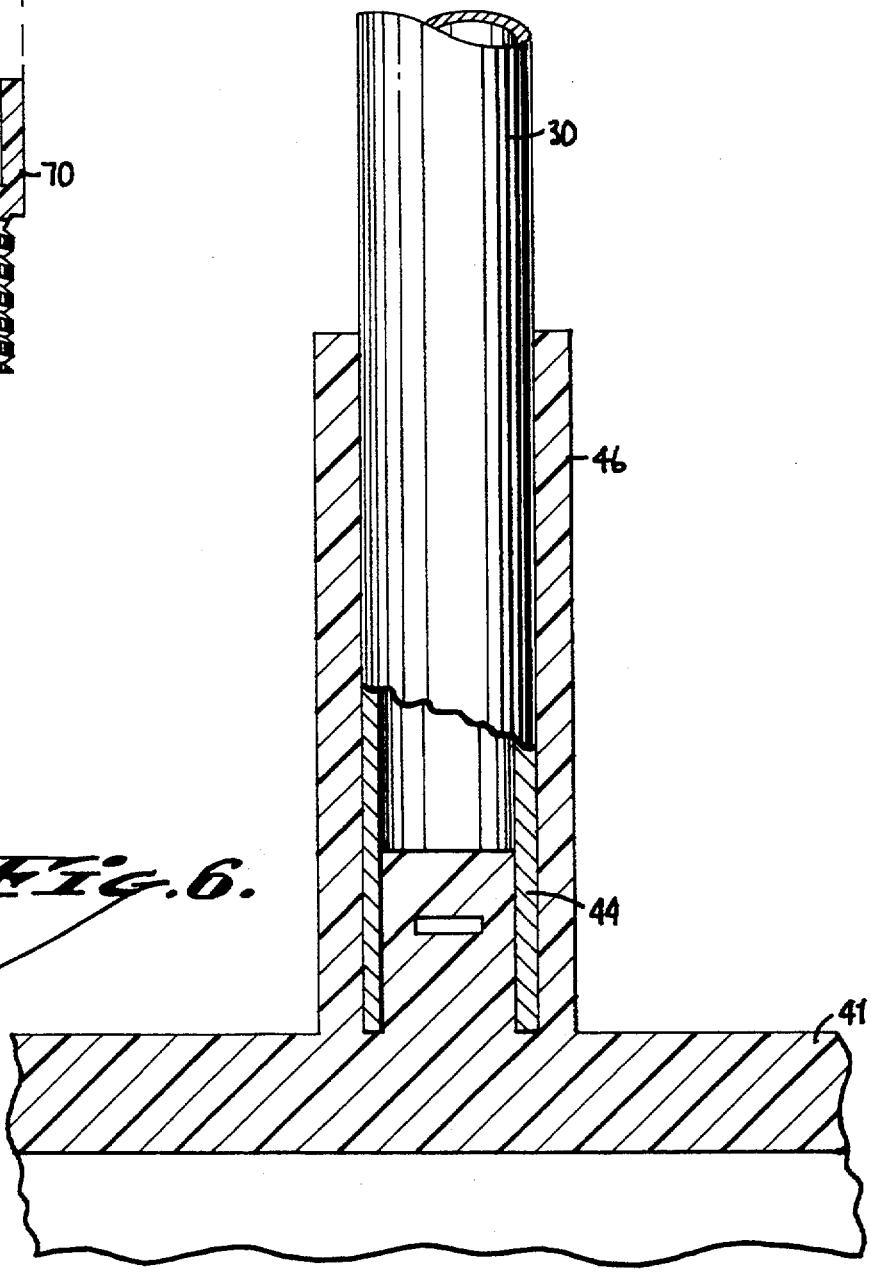
FIG. 6 is a partial section view of an alternative embodiment of the broom head, with the handle attached to the broom head.

Alternatively, the broom handle can be cylindrical and fitted into a cylindrical bore in the receptacle 44, for example fixed axially to the receptacle 44 by a lateral screw or pin passing through or into the handle from the receptacle. Alternatively, the broom handle can be cylindrical and fitted over a cylindrical receptacle 44. In this embodiment, the broom handle is preferably comprised of cylindrical steel tubing having a hollow inner diameter to fit over the cylindrical receptacle 44, for example fixed axially over the receptacle 44 by a lateral staple passing through or into the receptacle from the handle as shown in FIG. 6.

The socket structure comprises a support member 46, surrounding and axially extending a distance above the receptacle 44 to distribute a downward force acting on a broom handle during brooming operations along the entire length of the support member 46. In particular, the force distributing socket withstands forces that are applied unevenly to the broom head relative to the axis of the handle. The support member 46 defines a length and comprises at least two opposed sidewalls 48, 50 along a length engaging the handle. The at least two sidewalls define an axial interior cavity which is shaped and configured to receive and closely bear against the broom handle inserted therein. The support member 46 terminates at a distance from the receptacle 44 at a planar top or collar 52 having an axial interior cavity which is also shaped and configured to receive and support a broom handle inserted therein. The planar top 52 preferably bears on the handle around the full circumference, whereas the sidewalls bear on the handle over a limited portion of the circumference, for example about 60 to 70° each. Accordingly, the sidewalls define opposed cradles for the handle that resist forces in directions along the extension of the broom head as well as perpendicular to the direction of extension.

As shown in FIG. 2–4, the support member 46 and receptacle 44 are coaxial with the handle. The raised sidewalls can be integrally joined to the axial open socket positioned at the face of the broom head for receiving the end of the handle. Preferably, the receptacle 44 for the end of the handle is integrally formed on the face of the broom head and is molded integrally with the broom head, e.g., of plastic material such as polypropylene or polyethylene, to the desired configuration. The open socket can also be integrally formed within the plane of the broom head defining a depth extending into the body portion of the broom head (not shown). The receptacle 44 in the embodiment shown in FIG. 4 is internally threaded. In any event, the open socket of the receptacle is of suitable size and configuration to receive and secure the end of a conventional broom handle 30.

The support member 46 in the embodiments shown defines a length equal to about half the length of lateral extension of the broom head. The at least two raised sidewalls 48, 50 define an axial interior cavity 60 bearing against the handle over this length. The at least two raised sidewalls 48, 50 of the support member are configured such that they at least partly surround the receptacle 44 to couple forces to the handle, at the axial cavity 54 in planar top 52 and also along the distance from the top of receptacle 44 to the broom head 40. This configuration provides a rigid housing around and above the receptacle 44.

In addition, the axial interior cavity 60 of the at least two sidewalls and the axial cavity 54 of the planar top are axially located above the open socket of the receptacle 44 to establish an in-line opening having an inside diameter substantially equal to the outside diameter of the broom handle to be inserted therein. The cavities are of suitable size and configuration to receive a broom handle therein to form an interference fit. The support member 46 thereby provides a support housing around the receptacle 44 that distributes the applied brooming forces from the receptacle, i.e., the direct connection point of the broom handle to the broom head, to the entire length of the support member 46.

The at least two raised sidewalls 48, 50 and planar top 52 of the support member 46 are preferably integrally formed on the face of the broom head, the broom head ( but for the bristles) being integrally molded of durable plastic material. The support member 46 is preferably constructed of rigid plastic to provide a durable handle connection which maintains its structural integrity during continuous applied brooming forces experienced during vigorous use.

The at least two raised sidewalls 48, 50 further define an axial interior cavity 60 comprised of coaxial interior surfaces 56, 58. The coaxial interior surfaces 56, 58 are of suitable size and shape to engage a broom handle along their length with an interference fit, which thereby provides a force distributing surface along the interior axial cavity of the at least two sidewalls, the broom handle being inserted therein and secured into the open socket portion of the receptacle 44. Uneven forces on the broom head are distributed along the length of the interference fit instead of being concentrated at either or both of the handle end socket 44 and the top 52 of the support 46.

The coaxial interior surfaces 56, 58 define a length extending from Just above the top of the collar-like sidewalls 45 of the receptacle 44, being adjacent thereto, to the planar top 52 of the support member. The coaxial interior surfaces of the at least two sidewalls of the support member, thus define an axial channel of suitable size and configuration to engage a broom handle 30 inserted therein with an interference fit along the length of the surfaces, supporting a broom handle along the length of the support 46 and axially fixing the broom handle to the broom head.

As shown in FIG. 3, the interior surfaces 56, 58 of the sidewalls are concave, corresponding to a cylindrical broom handle. It would also be possible to employ the invention with handles have a non-round section at the end that is attached to the broom head.

The force distributing effect of the invention displaces brooming forces applied to a broom handle during brooming operations from the fulcrum or direct connection point between a broom head and a broom handle, i.e., the open socket of the receptacle 44, and also from the upper limit 52 of the support 46, to the entire length of the support member, thereby reducing pressure placed on the fulcrum point, i.e., the direct connection point between the broom head and the broom handle. Whereas forces on the fulcrum point which tend to cause disconnection or disengagement of the broom handle are thereby relieved, it is difficult or impossible to disengage the handle from the broom head accidentally, due to forces exerting in using and even abusing the broom.

The force distributing socket 42 which comprises the receptacle 44 and support member 46 is preferably positioned perpendicular to the plane of the broom head, thereby forming a T-shaped broom head arrangement. This configuration allows the broom construction to be a broom adapted for side-to-side sweeping motions. In addition, the force distributing socket 42 can be positioned angularly to the plane of the broom head for a push-pull type broom construction.

This invention having been disclosed, variations and additional embodiments in accordance with the invention will now be apparent to persons skilled in the art. Whereas the invention is not intended to be limited to the exemplary embodiments and will encompass a range of such variations, reference should be made to the appended claims rather than the foregoing specification to assess the scope of the invention in which exclusive rights are claimed.

I claim:

1. A broom head, comprising:

a body being generally elongated in a plane, and being formed with a bottom surface having means for attachment of broom material and a top surface having means for attachment of a handle that defines a circumference adjacent one end;

said handle attachment means comprising a handle support socket and a receptacle receiving and retaining the one end of the handle; and, said receptacle formed by a projection that extends from the top surface of the broom head and is adapted to frictionally engage the one end of the handle;

said handle support socket formed by a pair spaced rectangular sidewalls which extend away from the top surface of the broom head to a distance from the broom-head top surface where a top member extends between the rectangular sidewalls;

wherein the top member has an opening defined by a perimeter which surrounds an axially-limited portion of the circumference of the handle that is axially spaced from the one end of the handle; and, wherein the rectangular sidewalls define opposed coaxial interior concavities which are shaped and arranged to receive and closely bear against the handle inserted therebetween over angularly-spaced, angularly-limited portions of the circumference of the handle for distributing forces between the handle and broom head to reduce stresses in the receptacle.

2. The broom head of claim 1, wherein the handle attachment means extends perpendicular to a plane of the broom head.

3. The broom head of claim 1, wherein the handle attachment means is positioned at an angle relative to a plane of the broom head.

4. The broom head of claim 1, wherein the handle attachment means is integrally formed on the broom head.

5. The broom head of claim 1, wherein each coaxial interior concavity encompasses about 60°–70° around the circumference of the handle.

6. The broom head of claim 1, wherein the receptacle for the handle extends upwardly from said top surface of the broom head.

7. A broom construction, comprising:

an elongated handle that defines a circumference adjacent one end;

a broom head being generally elongated in a plane, and being formed with a bottom surface having means for attachment of broom material and a top surface having means for attachment of the handle;

said handle attachment means comprising a handle support socket and a receptacle receiving and retaining the one end of the handle; and, said receptacle formed by a projection that extends from the top surface of the broom head and is adapted to frictionally engage the one end of the handle;

said handle support socket formed by a pair of spaced rectangular sidewalls which extend away from the top surface of the broom head to a distance from the broom-head top surface where a top member extends between the rectangular sidewalls;

wherein the top member has an opening defined by a perimeter which surrounds an axially-limited portion of the circumference of the handle that is axially spaced from the one end of the handle;

wherein the rectangular sidewalls define opposed coaxial interior concavities which are shaped and arranged to receive and closely bear against the handle inserted therebetween over angularly-spaced, angularly-limited portions of the circumference of the handle for distributing forces between the handle and broom head to reduce stresses in the receptacle; and, wherein the handle is connected to said handle attachment means.

8. The broom construction of claim 7, wherein the handle attachment means is perpendicular to a plane defined by the broom head.

9. The broom construction of claim 7, wherein the handle attachment means is angled relative to a plane defined by the broom head.

10. The broom construction of claim 7, wherein the handle attachment means is integral with the broom head.

11. The broom construction of claim 7, wherein the receptacle for the handle protrudes from a plane defined by the top surface of the broom head.

12. The broom construction of claim 7, wherein the broom material comprises a plurality of debris gathering bristles arranged such that stiffer fibers are in the middle and softer fibers are on the edges.

13. The broom construction of claim 7, wherein the sidewalls define a length which is equal to about half of a perpendicular length of extension of the broom head.

14. The broom construction of claim 7, wherein each said concave coaxial interior concavity encompasses about 60°–70° around the circumference of the handle.

15. The broom construction of claim 1, wherein the handle is a cylindrical tube having a hollow inner diameter.

16. The broom construction of claim 15, wherein the receptacle is inserted in the one end of said handle.

* * * * *

UNITED STATES PATENT AND TRADEMARK OFFICE

CERTIFICATE OF CORRECTION

PATENT NO. : 5,371,916

DATED : December 13, 1994

INVENTOR(S) : Peter S. Vosbikian

It is certified that error appears in the above-indentified patent and that said Letters Patent is hereby corrected as shown below:

In column 2, line 4, change "Junction" to read --junction--.

In column 2, line 41, change "Joint" to read --joint--.

In column 8, line 55, insert --of-- before "spaced".

In column 10, line 35, change "claim 1" to read --claim 7--.

Signed and Sealed this

Twenty-fifth Day of April, 1995

Bruce Lehman

*Attest:*

BRUCE LEHMAN

*Attesting Officer*

*Commissioner of Patents and Trademarks*